US009364958B2

(12) United States Patent
Scimone et al.

(10) Patent No.: US 9,364,958 B2
(45) Date of Patent: Jun. 14, 2016

(54) PEN CUTTER

(71) Applicants: Thomas Scimone, Campbell, CA (US); Scot Brown Herbst, San Jose, CA (US); Bruce Allen Eisenhauer, Du Quoin, IL (US)

(72) Inventors: Thomas Scimone, Campbell, CA (US); Scot Brown Herbst, San Jose, CA (US); Bruce Allen Eisenhauer, Du Quoin, IL (US)

( * ) Notice: Subject to any disclaimer, the term of this patent is extended or adjusted under 35 U.S.C. 154(b) by 85 days.

(21) Appl. No.: 14/101,729

(22) Filed: Dec. 10, 2013

(65) Prior Publication Data

US 2014/0165409 A1 Jun. 19, 2014

Related U.S. Application Data

(60) Provisional application No. 61/739,710, filed on Dec. 19, 2012.

(51) Int. Cl.
*B26B 1/08* (2006.01)
*B26B 5/00* (2006.01)

(52) U.S. Cl.
CPC .. *B26B 1/08* (2013.01); *B26B 5/003* (2013.01)

(58) Field of Classification Search
CPC ..... B26B 1/08; B26B 5/003
USPC ..... 30/162, 286, 123, 124, 125, 335, 340, 30/342, 151, 293, 344; 222/80, 191, 192; 606/166–172, 181; 7/158, 160; 81/177.85; 401/195
See application file for complete search history.

(56) References Cited

U.S. PATENT DOCUMENTS

| | | | | | |
|---|---|---|---|---|---|
| 2,483,750 | A | * | 10/1949 | Bratrud | 30/162 |
| 3,657,812 | A | * | 4/1972 | Lee | 30/162 |
| D263,020 | S | * | 2/1982 | Rau, III | D8/99 |
| 4,730,613 | A | * | 3/1988 | Gordy | 606/172 |
| 4,895,147 | A | * | 1/1990 | Bodicky et al. | 606/182 |
| 5,908,432 | A | * | 6/1999 | Pan | 606/167 |
| 6,679,616 | B2 | * | 1/2004 | Miller | 362/189 |
| 6,799,918 | B1 | * | 10/2004 | Scolnik | 401/195 |
| 7,100,285 | B1 | * | 9/2006 | Huang | 30/162 |
| 7,237,340 | B2 | * | 7/2007 | Johnson et al. | 30/162 |
| 7,296,316 | B1 | * | 11/2007 | Wu | 7/158 |

FOREIGN PATENT DOCUMENTS

| | | | | |
|---|---|---|---|---|
| WO | WO 2005/089333 | * | 9/2005 | B26B 1/08 |

* cited by examiner

*Primary Examiner* — Ghassem Alie
(74) *Attorney, Agent, or Firm* — James M. Smedley LLC; James Michael Smedley, Esq.

(57) ABSTRACT

The present invention generally relates to pen cutters. Specifically, embodiments of the present invention relate to a pen cutter apparatus with an auto-retractable blade. Embodiments of the pen cutter apparatus are further comprised of a tether-hole and a blade slider button.

20 Claims, 6 Drawing Sheets

PEN CUTTER

CROSS-REFERENCE TO RELATED APPLICATIONS

This application claims the benefit of the following provisional application, each of which is hereby incorporated by reference in its entirety: U.S. Pat. App. No. 61/739,710 filed on Dec. 19, 2012 and entitled "Pen Cutter."

FIELD OF THE INVENTION

The present invention generally relates to pen cutters. Specifically, embodiments of the present invention relate to a pen cutter apparatus with an auto-retractable blade. Embodiments of the pen cutter apparatus are further comprised of a tether-hole and a blade slider button.

BACKGROUND

The pen cutter is tool familiar to many people due to its convenient size and ease of use. Typical pen cutters utilize a cap to cover the blade when the pen cutter is not in use. This creates a hazardous situation in two instances. First, while the pen cutter is being used, but temporarily set aside, the blade remains exposed, as it is inconvenient to replace the cap each time you set the pen cutter aside for only a brief moment. Second, the fact that many pen cutters have a detachable cap means that the cap inherently becomes lost or otherwise separated from the pen cutter itself. Clearly, both situations can leave a pen cutter with an exposed blade, which increases the risk that the blade of the pen cutter could accidentally cause injury someone or unintentionally damage an object.

Therefore, there is a need in the art for a pen cutter that utilizes an auto-retracting blade that prevents the blade of the pen cutter from being unnecessarily exposed. These and other features and advantages of the present invention will be explained and will become obvious to one skilled in the art through the summary of the invention that follows.

SUMMARY OF THE INVENTION

Accordingly, it is an aspect of the present invention to provide a pen cutter knife with an automatically retracting blade. Furthermore, it is an aspect of the present invention to provide a compact and versatile cutting tool with a well-balanced and ergonomic feel.

According to an embodiment of the present invention, a pen cutter knife, comprising: a body section, including a front cap configured with a blade outlet slot, a slider button slot, and a rear cap, wherein the front cap is secured to a front opening of the body section, the slider button slot is formed in a wall of the body section, and the rear cap is secured to a rear opening of the body section, a blade carriage contained within the body section, wherein the blade carriage is configured to hold a cutting blade, a slider button configured to pass through the slider button slot in the body section and engage with the blade carriage to form an actuation unit that is movable between at least two positions, wherein a first position of the at least two positions is when the slider button is in a rear position and the cutting blade is retracted within the front cap, wherein a second position of the at least two positions is when the slider button is in a forward position and the cutting blade is extended from the blade outlet slot, and a tension component configured to connect the blade carriage to an anchor point, wherein the tension component causes the cutting blade to be automatically refracted from the second position to the first position when the slider button is not held in the second position.

According to an embodiment of the present invention, body section is further comprised of a slider button grove formed as a depression in an outer wall of the body section in which the slider button moves between the first position and the second position.

According to an embodiment of the present invention, the slider button grove defines a movement limit boundary for the first position and the second position of the slider button.

According to an embodiment of the present invention, the slider button slot is formed in the bottom center of the slider button groove.

According to an embodiment of the present invention, the body section is further comprised of one or more carriage channel ribs that are formed within the body section and are adapted to prevent the blade carriage from rotating within the body section by interacting with one or more blade carriage channels on the blade carriage.

According to an embodiment of the present invention, the blade carriage is further comprised of one or more blade carriage channels that are formed on the blade carriage and are adapted to prevent the blade carriage from rotating within the body section by interacting with one or more carriage channel ribs on the body section.

According to an embodiment of the present invention, the pen cutter further includes a weight that contained within the body section and is adapted to provide ergonomic balance to the pen cutter.

According to an embodiment of the present invention, the rear cap is configured with a tether-hole.

According to an embodiment of the present invention, the rear cap is further comprised of a tether-hole component configured to provide additional structure for a tethering point.

According to an embodiment of the present invention, the front opening of the body section is configured with a body section alignment notch adapted to align the front opening of the body section with the front cap.

According to an embodiment of the present invention, the front cap is configured with a front cap alignment notch adapted to align the front cap with the front opening of the body section.

According to an embodiment of the present invention, the front cap attaches to the front opening of the body section with a twist-lock connection.

According to an embodiment of the present invention, the front cap is configured with a front cap alignment indicator that is adapted to show a proper alignment for attaching the front cap to the body section.

According to an embodiment of the present invention, the proper alignment is when the front cap alignment indictor is aligned with a body section alignment notch.

According to an embodiment of the present invention, the front cap is securely locked in place on the body section when a front cap alignment notch and a body section alignment notch are aligned.

According to an embodiment of the present invention, the tension component is one or more springs.

According to an embodiment of the present invention, the tension component is an elastic band.

According to an embodiment of the present invention, the actuation unit and the body section are configured to lock the actuation unit in the second position so as to cause the cutting blade to remain extended when the slider button is released.

According to an embodiment of the present invention, the cutting is configured to be manually retracted when the actuation unit is manually moved from the second position to the first position.

According to an embodiment of the present invention, at least two positions correspond to at least two cutting blade positions selected from a group of cutting blade positions comprising a fully retracted cutting blade, a partially extended cutting blade, and fully extended cutting blade.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

Figure 1:
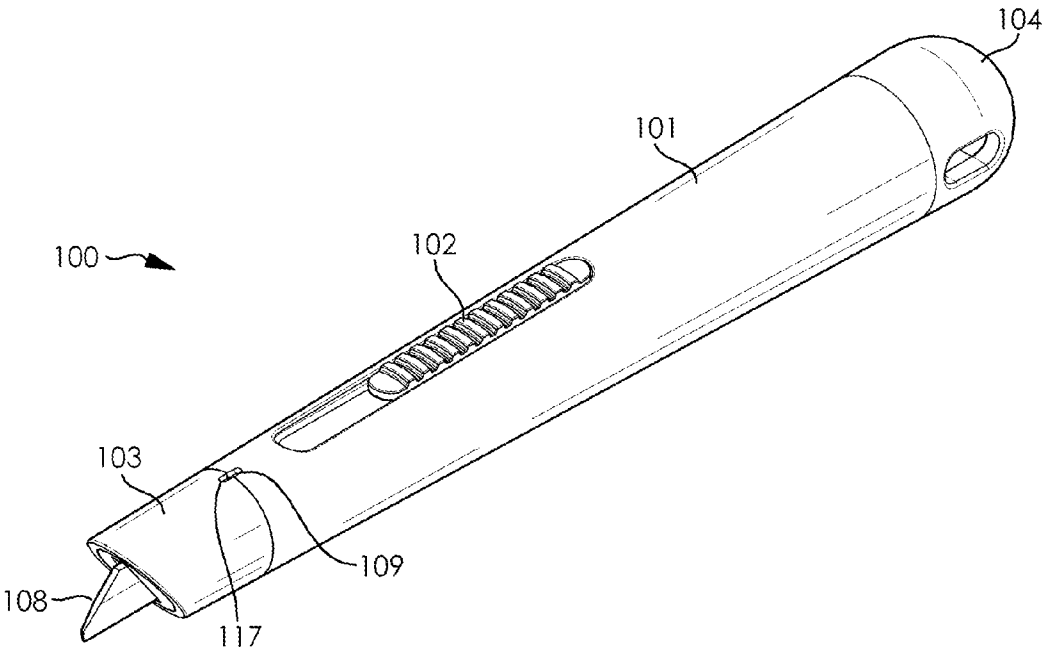
FIG. 1 is a perspective view of a pen cutter in accordance with an embodiment of the present invention.

The present invention generally relates to pen cutters. Specifically, embodiments of the present invention relate to a pen cutter apparatus with an auto-retractable blade. Embodiments of the pen cutter apparatus are further comprised of a blade slider button and a tether-hole.

According to an embodiment of the present invention, the pen cutter described herein is comprised of a body section, a slider button, a front cap, a rear cap, a blade carriage, a blade, a spring, and a weight. Certain embodiments of the present invention may include fewer components or additional components depending on the utilization and purpose for the pen cutter.

According to an embodiment of the present invention, the pen cutter is constructed from any suitable variety of durable materials. In a preferred embodiment, the majority of the components of the pen cutter are primarily comprised of plastic or a plastic composite material. In an alternate embodiment, the components of the pen cutter may be comprised of a metal or metal alloy. In the preferred embodiment, the pen cutter may be constructed from a variety of materials, for example, with i) the body section, slider button, front cap, rear cap, and blade carriage being constructed of a plastic material; ii) the spring and weight from metal; and iii) the cutting blade from ceramic. In a preferred embodiment, certain components of the pen cutter maybe comprised of a specific material based upon the application or function of a given component. As an illustrative example, the front cap may be made from glass filled nylon or a polyamide plastic that is more resistant to wear and therefore able to withstand the constant friction that the front cap encounters while in contact with a cutting surface. One of ordinary skill the art would appreciate that there are numerous suitable materials from which the components of the pen cutter could be constructed, and embodiments of the present invention are contemplated for use with any such material.

According to an embodiment of the present invention, the body section of the pen cutter is a substantially hollow cylinder configured to receive and retain the slider button, front cap, rear cap, blade carriage, spring, and weight. In a preferred embodiment of the present invention, the body section may be cylindrical and configured to receive a front cap at a front opening of the body section and a rear cap at a rear opening of the body section. In alternate embodiments, the body section may be of some other substantially regular tube shape, including but not limited to squares, triangles, hexagon, and octagons. Additionally, the inner wall of the body section may be configured with one or more carriage channel ribs that are adapted to correspond to one or more blade carriage channels on the blade carriage. In the preferred embodiment, the interaction between the blade carriage channels and the carriage channel ribs prevents the blade carriage from rotating within the body section. One of ordinary skill in the art would appreciate that there are many suitable designs for a pen cutter, and embodiments of the present invention are contemplated for use with any such design.

According to an embodiment of the present invention, the body section of the pen cutter is adapted to receive a rear cap. In a preferred embodiment, the rear cap is secured in such a manner as to help retain the other components of the pen cutter within the body section of the pen cutter. In the preferred embodiment, the rear cap is secured to the body with an ultrasonic seal. In a first alternate embodiment, the securing of the rear cap to the main body is may be effected through a snap-fit connection. In a second alternate embodiment, the rear cap may be secured to the main body with a friction-fit, which may optionally include the use of an adhesive. One of ordinary skill in the art would appreciate that there are numerous securing means for securing a rear cap to a pen cutter, and embodiments of the present invention are contemplated for use with any form of securing means.

According to an embodiment of the present invention, the rear cap may be formed of one or more pieces and may be configured to include a tether-hole. In a preferred embodiment, the rear cap is comprised of a rear cap shell and an inner tether-hole component. In the preferred embodiment the rear cap shell is configured with an opening that corresponds to the tether-hole of the tether-hole component, while the tether-hole component is configured to provide the structure for a tethering point. In the preferred embodiment, the tether-hole of the rear cap shell may be used to secure the pen cutter to a tether or lanyard. In alternative embodiment, the rear cap may be formed of a single piece. In the alternate embodiment, the rear cap maybe configured with or without a tether-hole. One of ordinary skill in the art would appreciate that there are numerous configurations for a rear cap, and embodiments of the present invention are contemplated with any such configuration.

According to an embodiment of the present invention, the front cap is configured with a blade outlet slot and may be formed of one or more pieces. In a preferred embodiment front cap is comprised of a front cap tip and a cap tip insert. In the preferred embodiment, the cap tip insert may be secured to the front cap tip with an ultrasonic seal. Alternative methods for securing the cap tip insert to the front cap tip include, but are not limited to, a snap-fit, a friction fit, and the use of adhesives. In alternative embodiment, the front cap may be formed of a single piece, wherein the blade outlet slot is integrally formed in the front cap. One of ordinary skill in the art would appreciate that there are numerous configurations for a front cap, and embodiments of the present invention are contemplated with any such configuration.

According to an embodiment of the present invention, the front cap is configured to reversibly attach to the body section of the pen cutter. In a preferred, the front cap attaches to the body section of the pen cutter via a twist-lock connection. The twist-lock connection causes the front cap to be firmly retained on the body section of the pen cutter until the front cap is rotated. Once the front cap has been rotated, the front cap can then be pulled off of the body section of the pen cutter. To reattach the front cap to the body section of the pen cutter, a user would simply realign the front cap with the body section of the pen cutter and rotate the front cap until it is locked in place. In the preferred embodiment, the front cap is removable to allow a user to access and change the blade of the pen cutter. In alternate embodiments, the front cap may be secured to the body section of the pen cutter with a snap fit, a friction fit, or a screw-on type connection. One of ordinary skill in the art would appreciate that there are suitable designs and uses for a removable front cap, and embodiments of the present invention are contemplated for use with any such design or usage.

According to an embodiment of the present invention, the front cap and body section of the pen cutter may be configured with one or more alignment means to facilitate the removable and attachment of the front cap to the body section of the pen cutter. In a preferred embodiment, the front cap is configured with a front cap alignment notch and a front cap alignment indicator (e.g. an arrow) and the body section of the pen cutter is configured with a body section alignment notch. In the preferred embodiment, when the front cap is attached and locked in place on the body section of the pen cutter, the front cap alignment notch and the body section alignment notch will line up with each other. In contrast, when the front cap is rotated to be unlocked, the front cap alignment notch and the body section alignment notch will no longer be aligned, indicating that the front cap can be pulled away from the body section of the pen cutter. Additionally, when a user wishes to reattach the front cap to the body section of the pen cutter, the user will position the front cap such that the front cap alignment indicator lines up with the body section alignment notch on the body section of the pen cutter. Aligning the front cap alignment indicator with the body section alignment notch facilitates a smooth reattachment of the front cap. With the front cap properly aligned and attached to the body section of the pen cutter, the user can then rotate the front cap until the front cap alignment notch and the body section alignment notch line up with each other indicating the front cap is locked in place. One of ordinary skill in the art would appreciate that there are numerous possible arrangements and purposes for an alignments on the pen cutter, and embodiments of the present invention are contemplated for use with any such alignment means.

According to an embodiment of the present invention, the pen cutter is configured retain a weight within a hollow cavity of the body section of the pen cutter. In a preferred embodiment of the present invention, the body section may be cylindrical. When the weight is placed inside the body section of the pen cutter, the weight is secured in such a manner as hold the weight in place. The weight rests within a notched portion of the inner wall of the body section. The weight is secured in place through a compression fit generated between the notched portion of the inner wall of the body section, the weight, and the rear cap. One of ordinary skill in the art would appreciate that there are numerous securing means for securing a weight inside a pen cutter, and embodiments of the present invention are contemplated for use with any form of securing means.

According to an embodiment of the present invention, the weight is placed at the opposite end of the pen cutter as the blade carriage. In a preferred embodiment, placing the weight at the opposite end from the blade carriage adds balance to the pen cutter and helps a user better control the bladed end of the pen cutter. The more control the user has over the pen cutter, the safer the user is when working with the pen cutter. Additionally, the weight may provide a means of balancing the pen cutter in a user's hand so as to maximize the ergonomics of the pen cutter. One of ordinary skill in the art would appreciate that there are numerous uses for a weight in a pen cutter, and embodiments of the present invention are contemplated to take advantage of any such use.

According to an embodiment of the present invention, the pen cutter is configured retain a spring within a hollow cavity of the body section of the pen cutter. In a preferred embodiment of the present invention, the body section may be cylindrical. When the spring is placed inside the body section of the pen cutter, the spring acts as a tension component and is secured in such a manner as to allow the blade to be automatically retracted. In a preferred embodiment, the spring is wrapped around the blade carriage at the spring attachment point and is further retained between a rim at the rear end of the blade carriage and notch in the wall of the cut in the wall of the body section. In an alternate embodiment, the spring is secured in place when the blade carriage is connected to the weight (i.e. the anchor point). The spring may be optionally connected to another anchor point (e.g. the tether-hole component or rear cap) instead of the weight. In any embodiment, the spring may be any another type of tension component, including but not limited to, an elastic band or other resilient element that enables the pen cutter to have an automatically retracting blade. One of ordinary skill in the art would appreciate that a spring numerous suitable arrangements for a spring inside of a pen cutter, and embodiments of the present invention are contemplated for use with any such spring arrangement.

According to an embodiment of the present invention, the pen cutter may include a blade carriage. In a preferred embodiment, the blade carriage is a relatively cylindrical component configured to be retained within the body section of pen cutter and is comprised of a blade holder, a slider button attachment point, and a spring attachment point. In the preferred embodiment, the blade holder is configured to securely hold a cutting blade. The slider button attachment point is adapted to connect to a slider button so as to facilitate the movement of the blade carriage. In a preferred embodiment, when the slider button is connected together with the blade carriage, the pair collectively forms the actuation unit.

The spring attachment point defines the area of the blade carriage where the spring wraps around the blade carriage. The preferred embodiment of the blade carriage is further defined by a front end terminating at the blade holder and rear end terminating at a rim that defines the end of the spring attachment point. Additionally, the blade carriage may be configured with one or more blade carriage channels that are adapted to correspond to one or more carriage channel ribs on the inner wall of the body section. In the preferred embodiment, the interaction between the blade carriage channels and the carriage channel ribs prevents the blade carriage from rotating within the body section. One of ordinary skill in the art would appreciate that the blade carriage could be designed in a variety of configurations, and embodiments of the present invention are contemplated for use with any such configuration.

According to an embodiment of the present invention, the pen cutter is configured to retain the blade carriage within a hollow cavity of the body section of the pen cutter. In a preferred embodiment of the present invention, the body section may be cylindrical and will retain the blade carriage in the middle of the body section of the pen cutter. In the preferred embodiment, the blade carriage will be configured to slide back and forth within the body section of the pen cutter. When the blade carriage is in the forward position, the blade will be extended beyond the front cap of the pen cutter. When the blade carriage is in the retracted position, the blade will retained within the front cap and body portion of the pen cutter. In the preferred embodiment, the blade carriage will be further engaged with the spring, which may allow the blade to be automatically retracted. One of ordinary skill in the art would appreciate that blade carriage may be designed in numerous configurations, and embodiments of the present invention are contemplated for use with any such configuration.

According to an embodiment of the present invention, the blade carriage will be configured to retain a cutting blade in a blade holder. In a preferred embodiment, the blade holder may be configured to retain a ceramic cutting blade. In an alternate preferred embodiment the blade holder may be configured to retain a standard metal blade. With the blade carriage being placed inside the body section of the pen cutter, the blade holder securely retains the blade in such a manner as to prevent the blade from becoming dislodged or otherwise falling out of the pen cutter. The securing of the blade in the blade holder is most commonly caused by a friction-fit formed between the blade carriage and the blade when placed inside the body section. One of ordinary skill in the art would appreciate that numerous cutting blades could be retained by the blade holder, and embodiments of the present invention are contemplated for use with any such cutting blade.

According to an embodiment of the present invention, the pen cutter may include a slider button. In a preferred embodiment, the slider button is comprised of a flat top portion and a blade carriage connection flange. In the preferred embodiment the flat top portion is a primarily flat surface that a user interacts with to extend the blade. The flat top portion of the slider button will rest in a grove on the outside wall of the body section. The blade carriage connection flange is a perpendicular appendage that extends from the bottom of the slider button. In the preferred embodiment, the blade carriage connection flange will pass through a slider button slot in the bottom of the slider button groove on the outside wall of the body section. The slider button will then be secured to the pen cutter when the blade carriage connection flange passes through the slider button slot and engages with the blade carriage within the hollow cavity of the main body. In a preferred embodiment, when the slider button is connected together with the blade carriage, the pair collectively forms the actuation unit. One of ordinary skill in the art would appreciate that there are numerous suitable designs for a slider button, and embodiments of the present invention are contemplated for use with any such design.

According to an embodiment of the present invention, the body section of the pen cutter may be configured with a slider button groove and a slider button slot. In a preferred embodiment, the slider button groove is a depression in the outer wall of the body section, while the slider button slot is an opening in the outer wall of the body section that is substantially contained within the groove. In the preferred embodiment, the groove defines the movement limits of the slider button, while the slider button slot allows the slider button to pass through the wall of the body section to engage with the blade carriage.

According to an embodiment of the present invention, the slider button is configured to move the blade into the extended position. In a preferred embodiment, a user will push the slider button forward, thereby causing the blade carriage within the body section of the pen cutter to be moved forward. With the blade carriage in the forward position, the blade will then be in an extended position beyond the front cap of the pen cutter. When the slider button is released or otherwise returned to the rear or retracted position, the blade carriage will likewise be returned to the retracted position causing the blade to be returned to the inside of the body portion of the pen cutter.

According to an embodiment of the present invention, the pen cutter has an auto-retracting blade. In a preferred embodiment, the blade of the pen cutter can be extended by pushing a slider button forward. Applying forward pressure to the slider button causes creates compression or tension (distortion from the neutral state) in a spring or other tension component that is connectively linked to the blade of the pen cutter via the blade carriage. When the slider button is released, the compression or tension in the spring (or other tension component) causes the blade of the pen cutter to be retracted as the spring returns to its unbiased or neutral resting state. One of ordinary skill in the art would appreciate that there are many methods to creating an automatically retracting blade, and embodiments of the present invention are contemplated for use with any such method.

According to an embodiment of the present invention, the pen cutter has a manually retracting blade. In a preferred embodiment, the blade of the pen cutter can be extended by pushing a slider button forward, as the slider button is connectively linked to the blade via the blade carriage. In one embodiment, the blade can be incrementally extended to cut through materials of varying thicknesses. Accordingly, the slider button may function in a ratchet-like fashion to lock at multiple positions that correspond to the varying extension of the blade (e.g. a first position where the blade is totally retracted, a second position where the blade is partially extended, and a third position where the blade is totally extended). To extend or retract the blade, the slider button could be depressed and moved to the appropriate position. Once the blade is extended or retracted to the appropriate position, the slider button could then be released and the blade would be locked into that position. In an alternate embodiment, the slider button may be lockable in a forward position so as to cause the blade to remain extended despite pressure from a tension component. In said embodiment, when the slider button is released from the locked position, the blade will be automatically retracted within the font cap of the blade cutter. The blade may be locked in the forward position by any suitable locking means including, but not limited to, a friction fit, a latching mechanism, or a ratcheting mechanism.

According to an embodiment of the present invention, the blades used in the pen cutter of the present invention may be constructed from a ceramic material that is capable of withstanding extended use without becoming dull or unusable. Ceramic materials appropriate for such construction include, but are not limited to, Zirconium Oxide. One of ordinary skill in the art would appreciate that there are numerous ceramic materials that could be utilized with embodiments of the present invention. Alternatively, embodiments of the present invention may be used with standard pen cutter blades.

According to an embodiment of the present invention, the blades used in the pen cutter may contain rounded tips to reduce the chance of injury.

Turning now to FIG. 1, a perspective view of a pen cutter, in accordance with an embodiment of the present invention. In a preferred embodiment, the pen cutter 100 is comprised of a body section 101, a slider button 102, a front cap 103, a rear cap 104, a blade carriage (not shown), a blade 108, a spring (not shown), a weight (not shown), a body section alignment notch 109 and a front cap alignment notch 117.

Figure 2:
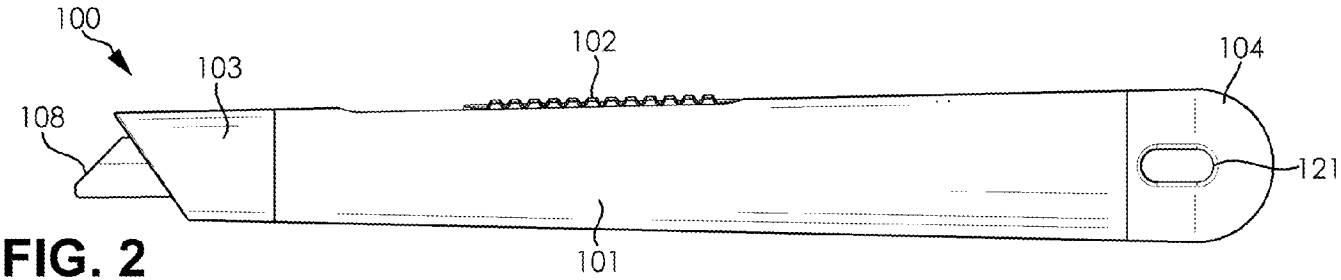
FIG. 2 is a perspective view of a pen cutter in accordance with an embodiment of the present invention.

Turning now to FIG. 2, a side view of a pen cutter, in accordance with an embodiment of the present invention. In a preferred embodiment, the pen cutter 100 is comprised of a body section 101, a slider button 102, a front cap 103, a rear cap 104, a blade carriage (not shown), a blade 108, a spring (not shown), a weight (not shown), and a tether-hole 121.

Figure 3:
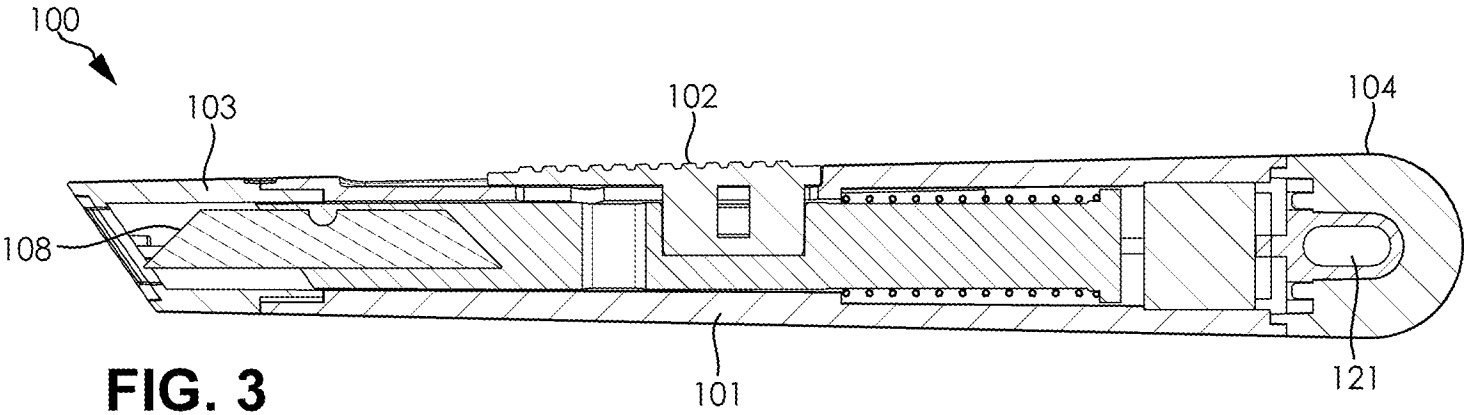
FIG. 3 is a sectional view of a pen cutter in accordance with an embodiment of the present invention.

Turning now to FIG. 3, a cross-sectional view of a pen cutter, in accordance with an embodiment of the present invention, is shown. In this illustration, a preferred embodiment of the pen cutter 100 is shown with the blade retracted. In the preferred embodiment, the pen cutter 100 is comprised of a body section 101, a slider button 102, a front cap 103, a rear cap 104, a blade carriage, a blade 108, a spring, a weight, and a tether-hole 121.

Figure 4:
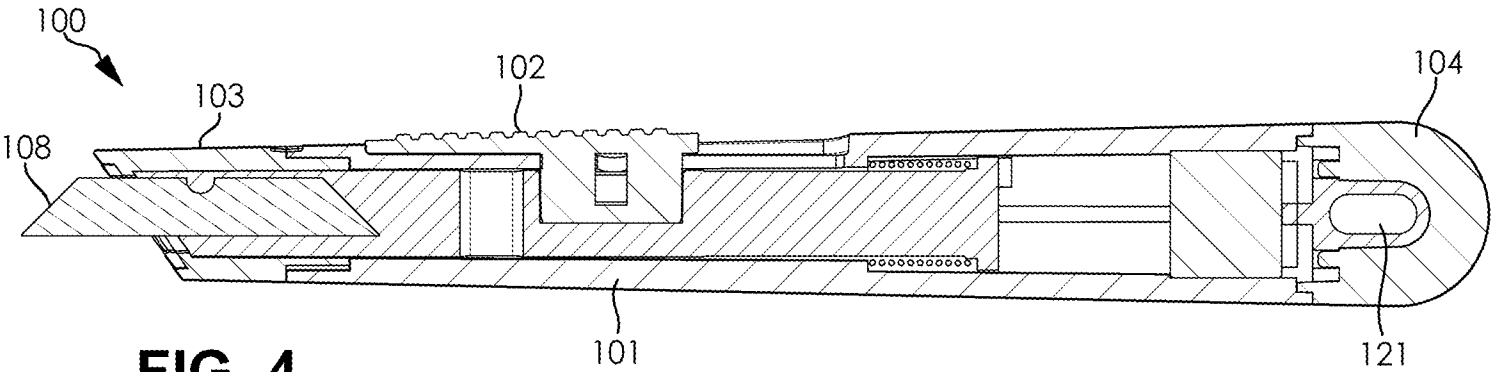
FIG. 4 is a sectional view of a pen cutter in accordance with an embodiment of the present invention.

Turning now to FIG. 4, a sectional view of a pen cutter, in accordance with an embodiment of the present invention, is shown. In this illustration, a preferred embodiment of the pen cutter 100 is shown with the blade extended. In the preferred embodiment, the pen cutter 100 is comprised of a body section 101, a slider button 102, a front cap 103, a rear cap 104, a blade carriage, a blade 108, a spring, a weight, and a tether-hole 121.

Figure 5:
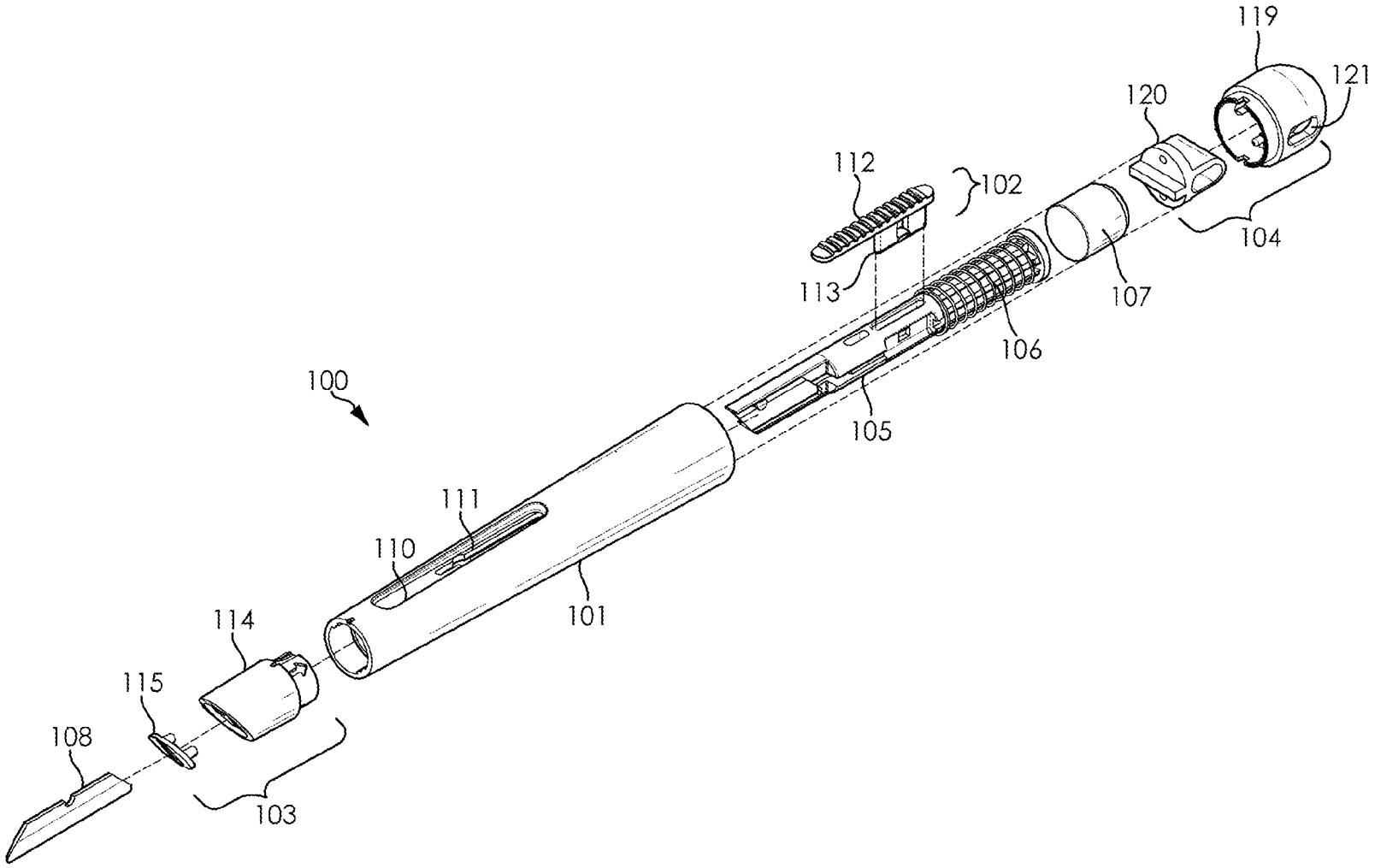
FIG. 5 is an exploded view of a pen cutter in accordance with an embodiment of the present invention.

Turning now to FIG. 5, an exploded view of a pen cutter, in accordance with an embodiment of the present invention. In a preferred embodiment, the main components that comprise the pen cutter 100 are a body section 101, a slider button 102, a front cap 103, a rear cap 104, a blade carriage 105, a spring 106, a weight 107, and a blade 108. The body section 101 is sealed at each end by the front cap 103 and the rear cap 104 and is configured to internally retain the blade carriage 105, spring 106, and weight 107. The body section 101 is further comprised of i) a body section alignment notch, ii) a slider button groove 110 where the slider button 102 rests, and iii) a slider button slot 111 where the blade carriage connector flange 113 of the slider button 102 passes through the body section 101 to connect to the blade carriage 105. The slider button 102 is further comprised of i) a flat top portion 112 that is used to move the blade carriage 105 and thereby extend the blade 108 and ii) a blade carriage connector flange 113 that connects the slider button 102 to the blade carriage 108. The front cap 103 is configured to reversibly engage with the body section 101 and is further comprised of a front cap tip 114, a cap tip insert 115, a blade outlet slot (not shown), a front cap alignment notch, and a front cap alignment indicator. The front cap alignment notch and front cap alignment indicator, along with the body section alignment notch, are used to align the front cap 103 on the body section 101 of the pen cutter 100 and ensure the front cap 103 is locked in place on the body section 101. The rear cap 104 is configured to attach to the rear of the body portion 101 of the pen cutter 100 and further to assist in holding the weight 107 in place. In a preferred embodiment, the rear cap 104 is further comprised of a rear cap shell 119 with a tether-hole 121 and a tether-hole component 120. The tether-hole component 120 and tether-hole 121 provide a means for a user to connect a key ring, lanyard, or other type of retaining means to the pen cutter 100. The blade carriage 105 is configured to slide within the body portion 101 of the pen cutter 100.

Figure 6:
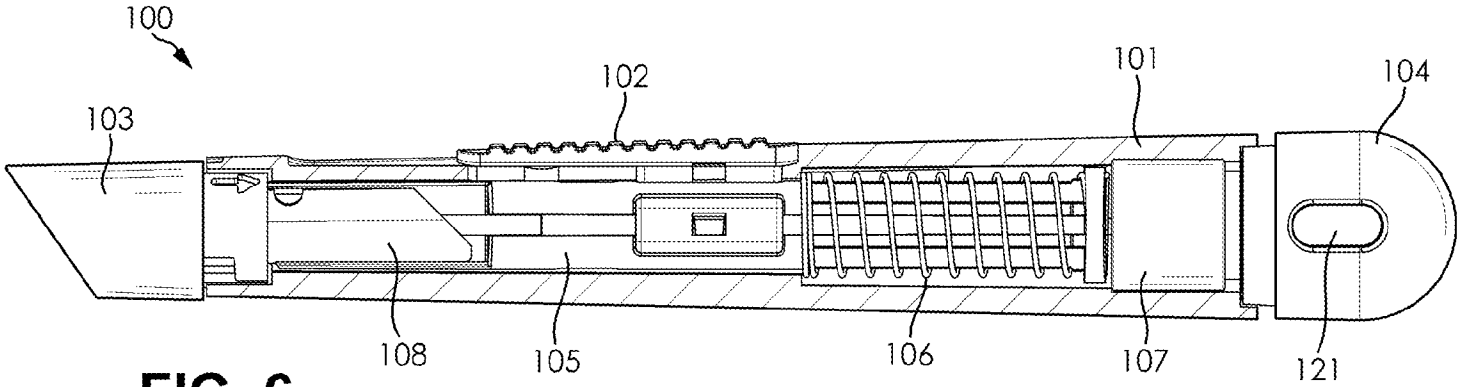
FIG. 6 is cut-away view showing internal components of a pen cutter with the cutting blade in a retracted position in accordance with an embodiment of the present invention.

Turning now to FIG. 6, a cut-away view of the internal components of a pen cutter, in accordance with an embodiment of the present invention, is shown. In this illustration, a preferred embodiment of the pen cutter 100 is shown with the blade retracted. In a preferred embodiment, when the blade is retracted, both the slider button 102 and the blade carriage 105 will be in a first or rear position. When the slider button 102 and blade carriage 105 are in the rear position, the spring 106 will be a neutral or uncompressed state and the blade 108 will be retracted within the front cap 103 and the body section 101. The spring 106 is wrapped around the blade carriage 105 at the spring attachment point and is further retained between a rim at the rear end of the blade carriage 105 and notch in the wall of the cut in the wall of the body section 101.

Figure 7:
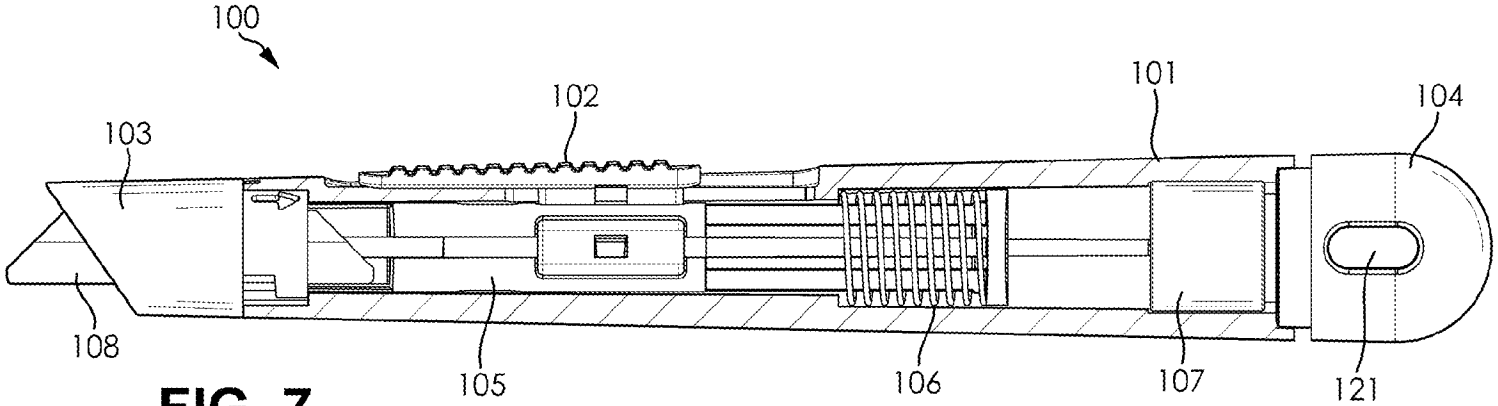
FIG. 7 is cut-away view showing internal components of a pen cutter with the cutting blade in an extended position in accordance with an embodiment of the present invention.

Turning now to FIG. 7, a cut-away view of the internal components of a pen cutter, in accordance with an embodiment of the present invention, is shown. In this illustration, a preferred embodiment of the pen cutter 100 is shown with the blade extended. In a preferred embodiment, when the blade is extended, both the slider button 102 and the blade carriage 105 will be in a second or forward position. When the slider button 102 and blade carriage 105 are in the rear position, the spring 106 will be a compressed state and the blade 108 will be extended beyond the front cap 103. The spring 106 is wrapped around the blade carriage 105 at the spring attachment point and is further retained between a rim at the rear end of the blade carriage 105 and notch in the wall of the cut in the wall of the body section 101. This configuration allows the pen cutter 100 to have an automatically retracting blade 108. In particular, the blade carriage 105 moves forward when the slider button 102 is likewise pushed forward. This movement causes the spring 108 to be compressed between the rim of the blade carriage 105 and a notch in the wall of the body section. When the slider button 102 is released, the tension in the spring 106 causes the blade 108 to be pulled back into the front cap 103 and body section 101, as shown in FIG. 6.

Figure 8:
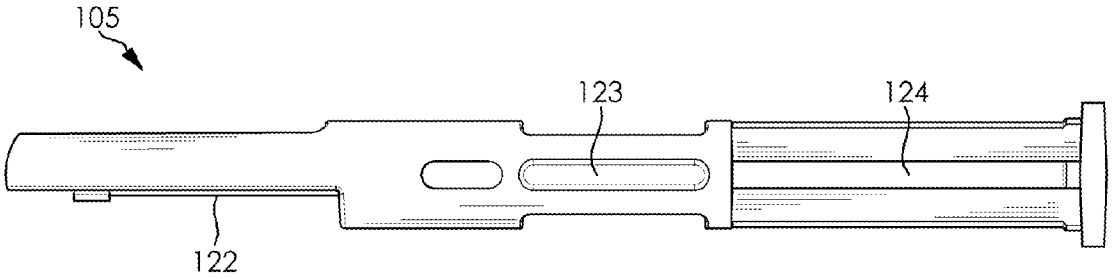
FIG. 8 is top perspective view of a blade carriage of a pen cutter in accordance with an embodiment of the present invention.
Figure 9:
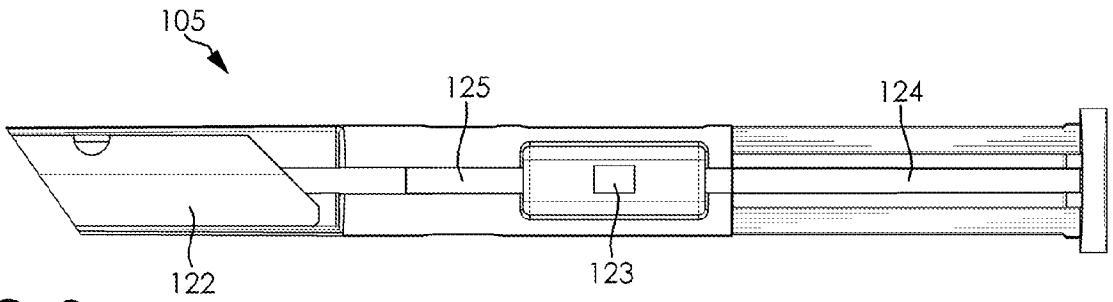
FIG. 9 is side perspective view of a blade carriage of a pen cutter in accordance with an embodiment of the present invention.

Turning now to FIG. 8 and FIG. 9, a top and side view, respectively, of a blade carriage of a pen cutter, in accordance with an embodiment of the present invention. In a preferred embodiment, the blade carriage 105 is comprised of a blade holder 122, a slider button attachment point 123, a spring attachment point 124, and a blade carriage channel 125. The blade carriage 122 is configured to hold a blade (not shown). The slider button attachment point 123 is configured to attach to the blade carriage connection flange (not shown) of the slider button (not shown). The spring attachment point 124 defines the area where the spring (not shown) wraps around the blade carriage 105. The blade carriage channel 125 interact with a carriage channel rib (not shown) on the body section (not shown) to prevent the blade carriage 105 from twisting around inside the pen cutter.

Figure 10:
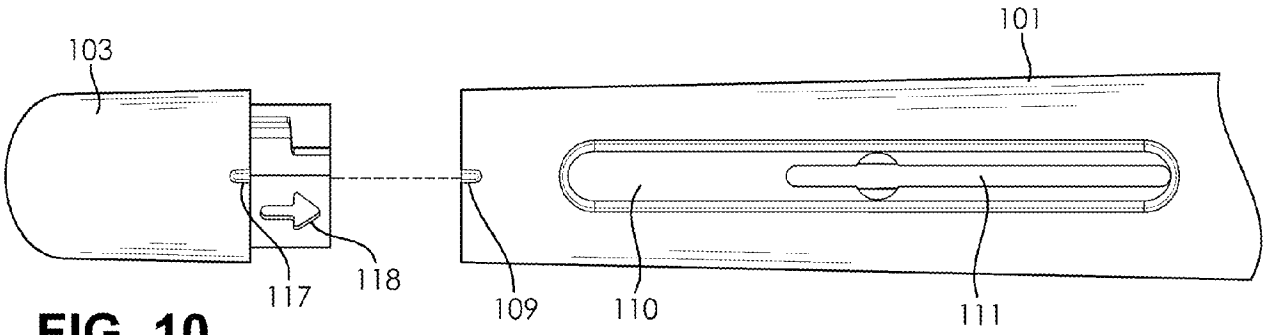
FIG. 10 is an illustration of a front cap separated from a body section of a pen cutter in accordance with an embodiment of the present invention.

Turning now to FIG. 10, is an illustration of a front cap connecting to the body section of a pen cutter. In a preferred embodiment, the front cap 103 connects to the body section 101 of the pen cutter by a twist-lock connection. To connect the front cap 103 to the body section 101, a user will line up the front cap alignment indicator 118 with the body section alignment notch 109 and slide the front cap 103 into the body section 101 together. The user will then rotate the front cap 103 until the front cap alignment notch 117 is aligned with the body section alignment notch 109 indicating the front cap 103 has been securely locked on to the body section 101 with the twist-lock connection. Additionally, this illustration shows the slider button grove 110 in which the slider button (not shown) rests, as well as the slider button slot 111 through which the blade carriage connection flange (not shown) passes to connect to the blade carriage (not shown).

Figure 11:
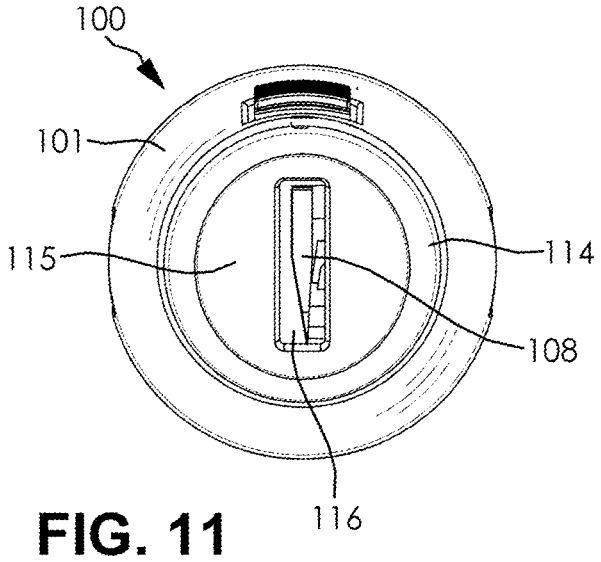
FIG. 11 is a front view of a pen cutter in accordance with an embodiment of the present invention.

Turning now to FIG. 11, a front view of the pen cutter in accordance with an embodiment of the present invention. In a preferred embodiment, the front cap is comprised of the front cap tip 114 and the cap tip insert 115, which is reversibly attached to the body section 101 of the pen cutter 100. The cap tip insert 115 is further comprised of a blade outlet slot 116, through which the blade 108 is extended in order to make a cut.

Figure 12:
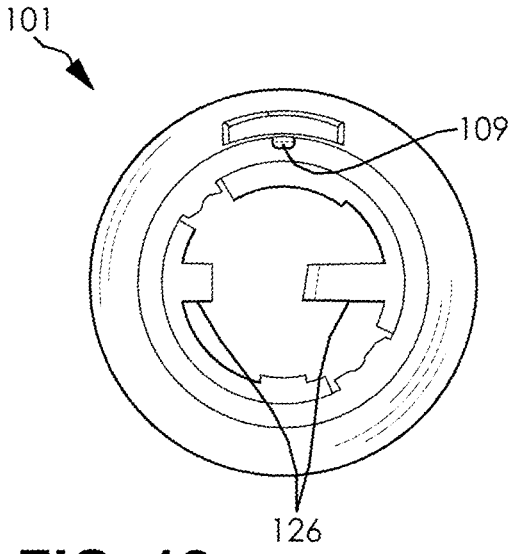
FIG. 12 is a front view of a body section of a pen cutter with the internal components removed in accordance with an embodiment of the present invention.

Turning now to FIG. 12, a front view of a body section of a pen cutter in accordance with an embodiment of the present invention. In this illustration, the body section 101 is shown by itself without any other components. In a preferred embodiment, the body section is comprised of a body section alignment notch 109 and one or more carriage channel ribs 126. The carriage channel ribs 126 are configured to correspond to and interact with one or more blade carriage channels (not shown) on the blade carriage (not shown) to prevent the blade carriage (not shown) from rotating within the body section 101.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A pen cutter knife, comprising:

a body section, comprising a front cap configured with a blade outlet slot, a slider button slot, a spring retaining notch, and a rear cap, wherein said front cap is secured to a front opening of said body section, said slider button slot is formed in a wall of said body section, said rear cap is secured to a rear opening of said body section, and said spring retaining notch is formed on an inner portion of said body section between said slider button slot and said rear opening;

a blade carriage retained within said body section and comprising a front end formed with a blade holder, a middle section formed with a slider button attachment point and spring attachment point, and a rear end formed with a rim, wherein said spring attachment point is formed between said slider button attachment point and said rim and has a smaller diameter than said rim;

a slider button configured to pass through said slider button slot in said body section and engage with said blade carriage to form an actuation unit that is movable between at least two positions, wherein a first position of said at least two positions is when said slider button is in a rear position and said cutting blade is retracted within said front cap, wherein a second position of said at least two positions is when said slider button is in a forward position and said cutting blade is extended from said blade outlet slot; and a spring wrapped around said spring attachment point and retained between said spring retaining notch and said rim of said blade carriage, wherein moving said slider button to said second position causes said spring to be compressed between said spring retaining notch and said rim of said blade carriage.

2. The pen cutter knife of claim 1, wherein said body section is further comprised of a slider button grove formed as a depression in an outer wall of said body section in which said slider button moves between said first position and said second position.

3. The pen cutter knife of claim 2, wherein said slider button grove defines a movement limit boundary for said first position and said second position of said slider button.

4. The pen cutter knife of claim 2, wherein said slider button slot is formed in the bottom center of said slider button groove.

5. The pen cutter of claim 1, wherein said body section is further comprised of one or more carriage channel ribs that are formed within said body section and are adapted to prevent said blade carriage from rotating within said body section by interacting with one or more blade carriage channels on said blade carriage.

6. The pen cutter of claim 1, wherein said blade carriage is further comprised of one or more blade carriage channels that are formed on said blade carriage and are adapted to prevent said blade carriage from rotating within said body section by interacting with one or more carriage channel ribs on said body section.

7. The pen cutter knife of claim 1, further comprising a weight that contained within said body section and is adapted to provide ergonomic balance to said pen cutter.

8. The pen cutter knife of claim 1, wherein said rear cap is configured with a tether-hole.

9. The pen cutter of claim 8, wherein said rear cap is further comprised of a tether-hole component configured to provide additional structure for a tethering point.

10. The pen cutter knife of claim 1, wherein said front opening of said body section is configured with a body section alignment notch adapted to align said front opening of said body section with said front cap.

11. The pen cutter knife of claim 1, wherein said front cap is configured with a front cap alignment notch adapted to align said front cap with said front opening of said body section.

12. The pen cutter of claim 1, wherein said front cap attaches to said front opening of said body section with a twist-lock connection.

13. The pen cutter knife of claim 12, wherein said front cap is configured with a front cap alignment indicator that is adapted to show a proper alignment for attaching said front cap to said body section.

14. The pen cutter knife of claim 13, wherein said proper alignment is when said front cap alignment indictor is aligned with a body section alignment notch.

15. The pen cutter of claim 12, wherein said front cap is securely locked in place on said body section when a front cap alignment notch and a body section alignment notch are aligned.

16. The pen cutter of claim 1, wherein said actuation unit and said body section are configured to lock said actuation unit in said second position so as to cause said cutting blade to remain extended when said slider button is released.

17. The pen cutter of claim 1, wherein said cutting blade is configured to be manually retracted when said actuation unit is manually moved from said second position to said first position.

18. The pen cutter of claim 1, wherein said at least two positions correspond to at least two cutting blade positions selected from a group of cutting blade positions comprising a fully retracted cutting blade, a partially extended cutting blade, and fully extended cutting blade.

19. The pen cutter of claim 1, wherein said blade carriage is a unitary component and said blade holder is formed as a depression in a lateral side of said blade carriage.

20. The pen cutter of claim 1, wherein said body section has a first internal diameter between said spring retaining notch and said rear opening and a second internal diameter between spring retaining notch and said front opening, said first internal diameter and said rim having a greater diameter than said second internal diameter.

* * * * *